United States Patent [19]

Buckingham

[11] 4,275,911

[45] Jun. 30, 1981

[54] SECURITY SEALS

[76] Inventor: Henry L. Buckingham, 95 McDonald St., Mordialloc, 3195, Victoria, Australia

[21] Appl. No.: 65,061

[22] Filed: Aug. 9, 1979

[30] Foreign Application Priority Data

Aug. 16, 1978 [AU] Australia ..... PD5511[U]
Sep. 20, 1978 [AU] Australia ..... PD6034[U]

[51] Int. Cl.[3] ..... B65D 33/34
[52] U.S. Cl. ..... 292/315
[58] Field of Search ..... 292/315, 307, 253, 317, 292/325

[56] References Cited

U.S. PATENT DOCUMENTS

| | | | |
|---|---|---|---|
| 1,137,183 | 4/1915 | Brooks | 292/315 |
| 1,234,739 | 7/1917 | Edgar | 292/315 |
| 1,569,294 | 1/1926 | Miller | 292/315 |
| 2,771,314 | 11/1956 | Canter et al. | 292/315 |

*Primary Examiner*—Richard E. Moore
*Attorney, Agent, or Firm*—Scully, Scott, Murphy & Presser

[57] ABSTRACT

The present invention provides a security seal of the type comprising a length of wire which has been so made that when a seal is made by twisting at least one end around the other end an attempt to untwist said at least one end is substantially likely to result in fracture of the wire characterized in that there is applied to the region of said at least one end which is to be twisted a material which, if heat is applied to said region in sufficient quantity such that the wire is likely to be rendered sufficiently ductile such that said at least one end may be untwisted without fracturing, by itself or with the wire will result in the security seal exhibiting a perceivably different appearance as compared to if such heat had not been applied.

7 Claims, 3 Drawing Figures

FIG. 1.
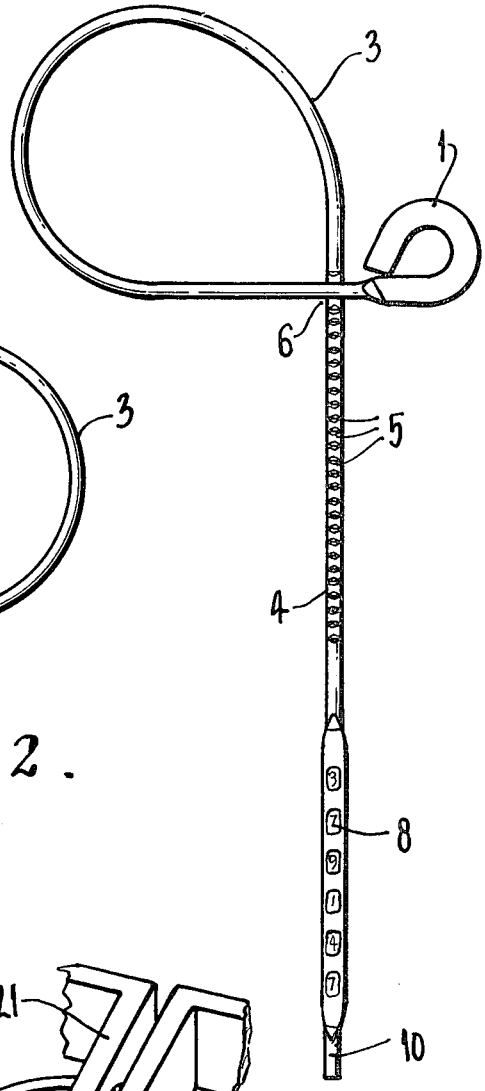
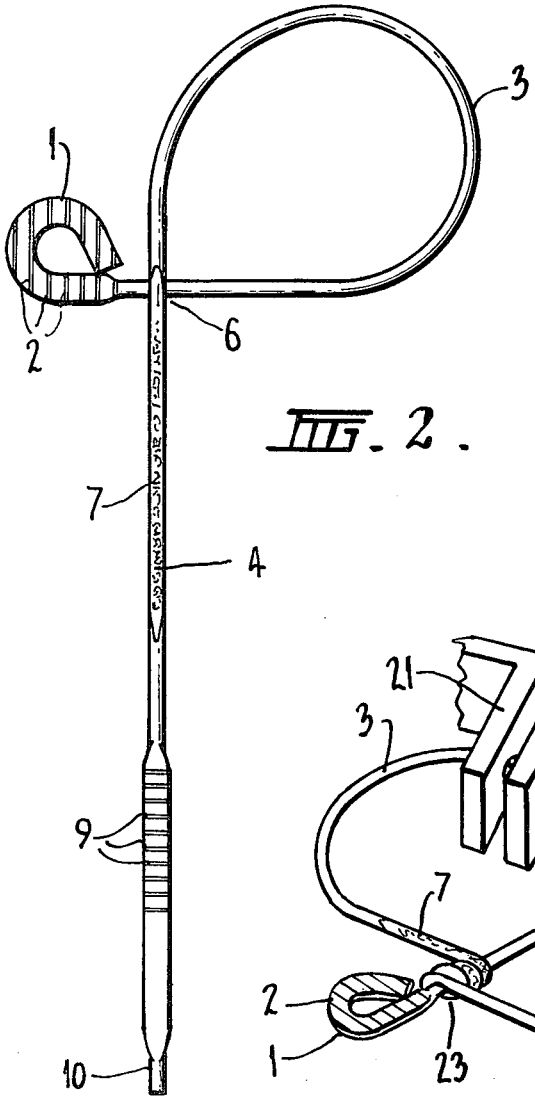
FIG. 2.
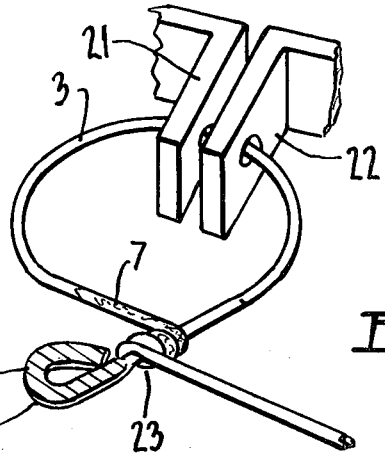
FIG. 3.

SECURITY SEALS

FIELD OF THE INVENTION

This invention relates to security seals.

BACKGROUND OF THE INVENTION

Security seals are known of the type comprising a length of wire which has been so made that when a seal is made by twisting at least one end around the other end an attempt to untwist said at least one end is substantially likely to result in fracture of the wire.

In some instances the wire is of such character or has been treated to have such character as to so substantially work harden as to fracture if that untwisting should be performed. In an alternative but which may be additional to the previous the wire is provided with lines of preferential fracture on the part thereof which will be an inside curve after the twisting and at which lines the wire will tend to fracture if that untwisting should be performed. Those lines of preferential fracture may be produced by stamping the wire and this may be done to produce substantial work hardening thereof and/or reduced cross-section in localities.

Unfortunately, criminals have discovered that security seals of the above type can often be successfully tampered with without leading to such fracture if the wire is heated in the region in which it has been twisted prior to untwisting. Indeed, if sufficient heat is applied the wire can be re-twisted after untwisting to give the appearance that the wire has not been tampered with.

Since distant visual sighting of such seals is an important aspect of maintaining security of railway wagons, containers and trucks, this new found ability to tamper without this being remotely discernable is most inconvenient to those wishing to maintain security of goods and establishments.

SUMMARY OF THE INVENTION

The present invention provides a security seal of the type comprising a length of wire which has been so made that when a seal is made by twisting at least one end around the other end an attempt to untwist said at least one end is substantially likely to result in fracture of the wire characterised in that there is applied to the region of said at least one end which is to be twisted a material which, if heat is applied to said region in sufficient quantity such that the wire is likely to be rendered sufficiently ductile such that said at least one end may be untwisted without fracturing, by itself or with the wire will result in the security seal exhibiting a perceivably different appearance as compared to if such heat had not been applied.

In this respect, as a consequence of the heating said material itself may disappear, discolour, change colour or appearance or at least fade such that the seal is discernably different.

As the heat will probably be applied by a flame which will probably be an oxidizing flame said material may be one which oxidizes and as a result is discernably different. As redox reactions can usually be reversed it might be thought that application thereto of a reducing chemical might reverse the change but in this respect said material is preferably chosen such that a reductant capable of returning an oxidised state of said material to a reduced state will affect the wire itself to produce a change in the appearance of the wire. Thus, said material might be restorable to its previous state and exhibit no apparent change but the wire per se should exhibit a change.

It is conceivable that the wire, after exhibiting such a change might be cleaned so as not to exhibit such a change and reference is now made to the below.

It may be that said material may exhibit no apparent change as a result of the heating but in this instance the wire per se should exhibit a discernable change as a result of the heating. In this respect, if the wire is made of galvanized iron, as is very practicable, it will probably show a discolouration as a result of heating.

That discolouration of galvanized iron can be readily removed by the use of steel wool or other abrasive and is particularly easy to remove if soap impregnated steel wool is used.

Having regard to the fact that an attempt may be made to clean the wire per se I now recommend that said material be one which, in the process of an attempt to restore the wire per se to its appearance before being heated, will suffer a discernable change. In this last respect, said material may be such as to easily rub off the wire or may disappear, discolour, change colour or appearance as a result of the attempt to restore the wire per se to its appearance before being heated.

Said material is preferably applied in some pattern the change in which, or alteration of which, will be easily perceived. In one instance, said material is applied in a geometric pattern which will show a change as a result of a removal of part thereof. In another instance said material is applied as printing and in this respect if any one letter disappears, discolours, changes colour or appearance this should be readily perceivable.

In another instance said material is such that the application of heat thereto will produce an irreversible perceivable change.

It is currently preferred to print on the wire words or numerals, such as the name of the manufacturer, using, as a printing medium one, other or both of cupric nitrate and cupric chloride; these are conveniently used in ethanol solution. Such a printing medium will tend to discolour if heated. Further, the wire should show a discolouration and any attempt to clean the wire should result in obliteration of the printing.

Other materials for application to the security seal include ink, paint, resin or plastic.

BRIEF DESCRIPTION OF THE VIEWS OF THE DRAWINGS

FIG. 1 is a view from one side of a security seal in accordance with this invention, FIG. 2 is a view from the other side of the security seal shown in FIG. 1, and FIG. 3 is a perspective view of the security seal of FIG. 1 in use.

DETAILED DESCRIPTION WITH RESPECT TO THE DRAWINGS

The security seal shown in FIGS. 1 and 2 is of galvanized wire and has a small loop 1 at one end which has been flattened and grooved as at 2, a large loop 3 and a straight portion 4.

The straight portion 4 has transverse grooves 5 on one side, the side which overlays at 6 on the other end of the loop 3, printing 7 on the side opposite said one side, a serial number 8 and transverse grooves 9 on the side opposite to the serial number 8.

The printing 7, in this case the name of the manufacturer of the security seal, was produced by applying a solution with a printing roller (but any other manner of application may be used).

The solution used comprised, in parts by volume, 5 parts of copper nitrate, 3 parts of water, 1 part of concentrated hydrochloric acid and 6 parts of ethanol.

That solution reacted with the zinc coating of the wire to form the printing.

In use, the end 10 is passed through two apertured lugs 21 and 22 on the door of a container or like and thereafter the straight portion 4 is twisted (at 23) about said other end of the loop 3. The nature of the wire and the grooves 5 permit this twisting.

Thereafter the seal will look somewhat as is shown in FIG. 3.

If an attempt is made to untwist the wire, open the loop 1, or bend the wire adjacent the serial number 8 the wire will break to show evidence of an attempt to tamper.

If, however, heat is applied it might be possible to untwist the wire without it breaking. However, in this eventuality the printing will partly discolour and further a discolouration will appear on the zinc coating of the wire. If an attempt is made to clean off that deposit such as with steel wool the printing will be rubbed off to provide evidence of the attempt to tamper.

The seal described above will be more proof against tampering than certain previous seals and thus will be an aid to security.

In an alternative, the wire is provided with a sheathing or coating of a synthetic plastics material. That sheathing or coating may itself be affected by heat or may bear printing, a pattern or embossing which may be affected by heat.

In this specification, the word "wire" is to be understood as including strip or strap or other material having characteristics making it suitable for use in this invention.

Modifications and adaptations may be made to the above described without departing from the spirit and scope of this invention which includes every novel feature and combination of features disclosed herein.

I claim:

1. A security seal comprising a length of wire which is constructed to form a seal by twisting at least one end around the other end and wherein the seal is designed to result in fracture of the wire if an attempt is made to untwist said at least one end, characterized in the application to the region of said at least one end which is to be twisted of an orderly pattern of a material which results in the security seal exhibiting a perceivably different appearance if heat is applied to said region to render it sufficiently ductile such that said at least one end may be untwisted without fracturing, and said material also exhibiting a perceivably different appearance if mechanical work is performed on the seal to restore its appearance to that prior to the application of heat, whereby the orderly pattern of material is affected to result in the security seal exhibiting a perceivably different appearance when an attempt is made to tamper with the seal.

2. A security seal as claimed in claim 1, wherein said orderly pattern of material is a geometric pattern.

3. A security seal as claimed in claim 1, wherein said orderly pattern of material is a pattern of symbols.

4. A security seal as claimed in claim 1, wherein said orderly pattern is a pattern of alphanumeric characters.

5. A security seal as claimed in claim 1, wherein said material discolours with the application of heat such that the seal is discernably different if heat is applied thereto.

6. A security seal as claimed in claim 1, wherein said material is an oxidizable material which oxidizes if heat is applied thereto.

7. A security seal as claimed in claim 1, wherein said wire is formed of an oxidizable material which oxidizes if heat is applied thereto.

* * * * *